US007510296B2

(12) United States Patent
Nevin

(10) Patent No.: US 7,510,296 B2
(45) Date of Patent: Mar. 31, 2009

(54) LED ILLUMINATED SCREWDRIVER

(76) Inventor: Donald Nevin, 3 Clearmedow Ct., Woodbury, NY (US) 11797

( * ) Notice: Subject to any disclaimer, the term of this patent is extended or adjusted under 35 U.S.C. 154(b) by 0 days.

(21) Appl. No.: 12/006,516

(22) Filed: Jan. 3, 2008

(65) Prior Publication Data

US 2008/0316765 A1 Dec. 25, 2008

Related U.S. Application Data

(60) Provisional application No. 60/936,269, filed on Jun. 19, 2007.

(51) Int. Cl.
*F21V 33/00* (2006.01)

(52) U.S. Cl. ..... 362/119; 362/120

(58) Field of Classification Search ..... 362/109, 362/119, 120, 205, 206
See application file for complete search history.

(56) References Cited

U.S. PATENT DOCUMENTS 2,670,427 A * 2/1954 Barlet et al. ..... 362/120
5,510,962 A * 4/1996 Hsiao ..... 362/120
5,826,969 A * 10/1998 Nevin ..... 362/120
6,478,442 B2 * 11/2002 Chen ..... 362/119

* cited by examiner

*Primary Examiner*—Thomas M Sember
(74) *Attorney, Agent, or Firm*—Robert L. Epstein; Epstein Drangel Bazerman & James, LLP

(57) ABSTRACT

The screwdriver has a handle and a rigid shaft that extends from the handle. The shaft has an end for engaging a screw. It also has a bore that extends from the handle to the screw-engaging end of the shaft. A LED is situated in the bore, proximate the screw-engaging end of the shaft. The handle has a recess. A battery is situated within the recess. The LED is electrically connected to battery by a wire extending through the bore, between the LED and the handle. Interchangeable heads are provided for use with screws of various configurations.

12 Claims, 3 Drawing Sheets

LED ILLUMINATED SCREWDRIVER

CROSS-REFFERENCE TO RELATED APPLICATIONS

Priority is claimed on Provisional Application Ser. No. 60/936,269, filed Jun. 19, 2007.

STATEMENT REGUARDING FEDERALLY SPONSERED RESEARCH OR DEVELOPMENT

Not applicable

REFFERENCE TO A "SEQUENCE LISTING", A TABLE, OR A COMPUTER PROGRAM LISTING APPENDIX SUBMITTED ON COMPACT DISC

Not applicable

BACKGROUND OF THE INVENTION

1. Field of the Invention

The present invention relates to tools for driving fasteners such as screws, and more particularly, to an illuminating screwdriver having an LED situated in a bore extending through the shaft.

2. Description of Prior Art Including Information Disclosed Under 37 CFR 1.97 and 1.98

Tools for driving fasteners such as screws are common. Conventional tools of this type include a solid handle, made of plastic, rubber, or wood, from which a rigid metal shaft extends. The screw-engaging end of the shaft is shaped to engage a correspondingly shaped recess in the screw head. For conventional screw heads, the shaft end is tapered to form a blade.

Screwdrivers sometimes must be used to drive screws in poorly lighted places. In such instances, a light source may be required to provide sufficient light to enable the user of the screwdriver to correctly align the screw-engaging end of the screwdriver with the recess in the screw head. A flashlight or other portable light source could be used if space permits. However, such light sources must be held by the user while using the screwdriver, forcing the user to manipulate the screwdriver and the screw with one hand, while holding the light source with the other. Manipulating the screwdriver and the screw with one hand is difficult.

In order to overcome this problem, screwdriver handles have been fashioned to include a battery and a standard incandescent flashlight-type bulb which shines light from the front of the handle along the exterior of the shaft, toward the screw-engaging end of the shaft. See, for example, Singleton, U.S. Pat. No. 4,107,765; Nalbandian U.S. Pat. No. 4,283,757; McKain U.S. Pat. No. 5,369,555; Berg, U.S. Pat. No. 4,936,171 and Barlet et al. U.S. Pat. No. 2,670,427.

However, the devices disclosed in the above mentioned patents have a disadvantage inherent in having such a bulb located in the handle, and thus far from the screw-engaging end of the shaft, which is the point where illumination is required. Because the light from the bulb spreads out as it travels along the shaft, and because of the limitations on the light output of a standard battery operated incandescent bulb, placing the bulb in the handle has proven to be less than adequate for illuminating the area immediately in front of the blade of the screw-engaging end of the shaft.

U.S. Pat. No. 1,603,985 to Rosenberg unsuccessfully attempted to overcome that problem by placing the bulb within a bore in the shaft. That arrangement required a very small bulb which provided inadequate light and, at the same time, required such a large bore to accommodate the bulb that the strength of the shaft is weakened substantially.

Another attempt to overcome the problem inherent in the above mentioned patents is disclosed by Jong-Pyng Jeng, in U.S. Pat. Nos. 5,124,893 and 5,211,468. Those patents teach a device in which bulbs are mounted in a member which slides along the shaft. That configuration allowed the bulbs to be situated close to the screw-engaging end of the shaft. However, the bulb-carrying member resulted in an extremely cumbersome tool in which the view of the screw-engaging end of the shaft is at least partially obstructed when the bulb-carrying member is situated close enough to the blade to provide adequate illumination Further, the device required exposed wires extending from the bulb-carrying member to the handle where the battery is located.

In my U.S. Pat. No. 5,826,969, a screwdriver is disclosed in which the handle has a cavity for retaining a battery and a standard incandescent bulb. The shaft, extending from one end of the handle, is provided with a bore or channel extending from the handle and through the screw-engaging end of the shaft. The blade at the end of the shaft is bifurcated, having blade sections one either side of the bore opening. The bore guided light from the bulb down the shaft and out the end of the shaft, to illuminate the area proximate the front of the blade.

That invention overcame the disadvantages of the above noted prior art structures by utilizing a light guiding bore extending within the interior of the shaft and a bifurcated blade at the screw-engaging end of the shaft. The bore directs the light down the shaft and through the bifurcated blade to illuminate the area proximate the front of the screw-engaging end of the shaft. However, the structure of U.S. Pat. No. 5,826,969 still does not provide an optimum result.

It has been suggested, for example in U.S. Pat. No. 4,302,797 to Cooper, that a fiber optic bundle be used in the bore of the shaft to convey light from bulb in the handle to the screw-engaging end of the shaft. However, even that approach has proven inadequate.

The present invention constitutes a further improvement over my patented device, and that proposed by Cooper. It utilizes a LED instead of an incandescent bulb as the light source. Further, the LED is situated within the bore of the shaft, at a location proximate the end of the screw-engaging end of the shaft, instead of in a remote position in the handle.

Since the LED is situated close to the end of the shaft, the light from the LED does not spread out to any significant extent and almost all of the light is focused on the point where illumination is required. Thus, the relatively high intensity light from the LED provides ample illumination, exactly where it is needed to illuminate the area in front of the screw-engaging end of the shaft.

Further, because the diameter of the LED is quite small, the inner diameter of the bore can be small relative to the outer diameter of the shaft. Hence, the bore does not significantly reduce the strength of the shaft.

The LED is connected to the battery power source in the handle by wires that extend through the bore, from the handle to the LED. A spring-loaded pushbutton switch is situated on the exterior of the handle to actuate the LED when depressed.

It is therefore, a prime object of the present invention to provide a LED illuminated screwdriver.

It is another object of the present invention to provide a LED illuminated screwdriver in which adequate illumination of the area in front of the screw-engaging end of the shaft is provided by mounting the LED close to the end of the shaft.

It is another object of the present invention to provide a LED illuminated screwdriver in which the LED is mounted within a bore extending though the shaft.

It is another object of the present invention to provide a LED illuminated screwdriver in which the strength of the shaft is not weakened substantially by the bore in which the LED is situated.

It is another object of the present invention to provide a LED illuminated screwdriver in which the inner diameter of the bore is relatively small as compared to the outer diameter of the shaft.

It is another object of the present invention to provide an LED illuminated screwdriver with interchangeable heads for use with multiple screw heads having various configurations.

BRIEF SUMMARY OF THE INVENTION

In general, those objects are achieved by the present invention which relates to a screwdriver with a handle and a rigid shaft having a screw-engaging end. The shaft extends from the handle and has a internal bore. The bore extends through the shaft from the handle to the screw-engaging end of the shaft. A LED is situated in the bore, proximate the screw-engaging end of the shaft. The handle has a recess. A battery is situated within the recess. Means are provided for electrically connecting the LED and the battery to energize the LED to illuminate the area proximate the screw-engaging end of the shaft.

The connecting means includes wires extending within the bore, between the LED and the handle. The connecting means also includes a switch for operably connecting the wires and the battery to energize the LED.

The shaft preferably has an outer diameter of approximately one quarter inch. The bore preferably has an inner diameter of approximately one eight inch.

In the first preferred embodiment, the screw-engaging end of the shaft takes the form of a bifurcated blade. The blade includes spaced blade sections. The spaced blade sections are situated on either side of the bore opening so as not to block the light from the LED.

The screwdriver handle has an end with a cover member. The cover member is removable to permit access to the battery recess.

In a second preferred embodiment of the screwdriver of the present invention, the screw-engaging end includes at least one removable head. Preferably, a plurality of interchangeable heads designed to be mounted on the screw-engaging end of the shaft are provided for use with screws having different configurations. Each head is provided with a bore which aligns with the shaft bore such that light from the LED can travel through the head mounted on the screw-engaging end of the shaft.

BRIEF DESCRIPTION OF THE SEVERAL VIEWS OF DRAWINGS

To these and to such other objects that may hereinafter appears, the present invention relates to a LED illuminated screwdriver as described in detail in the following specification and recited in the annexed claims, taken together with the accompanying drawings, in which like numerals refer to like parts and in which:

DETAILED DESCRIPTION OF THE INVENTION

Figure 1:
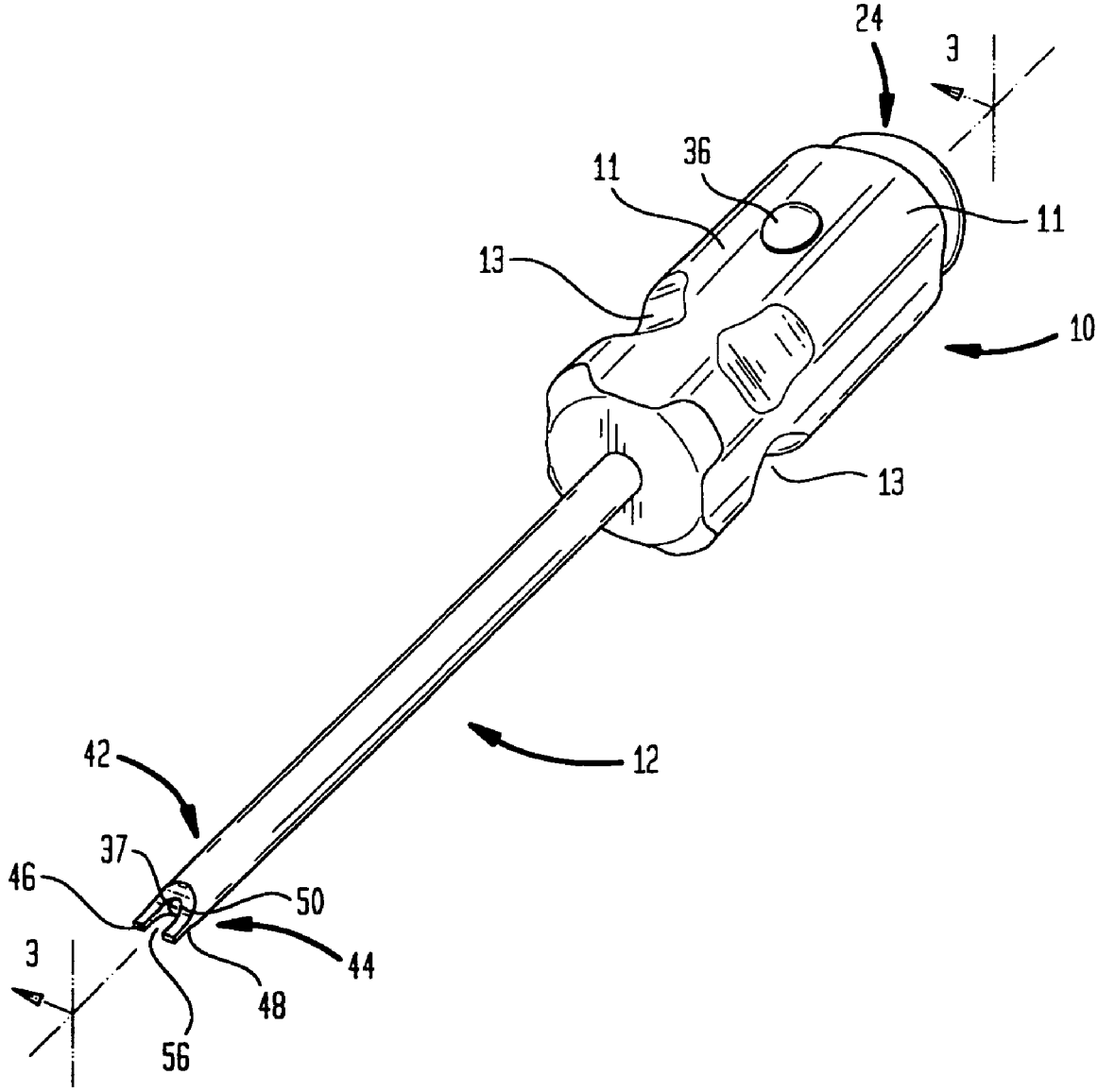
FIG. 1 is a perspective view of a first preferred embodiment of the present invention.
Figure 2:
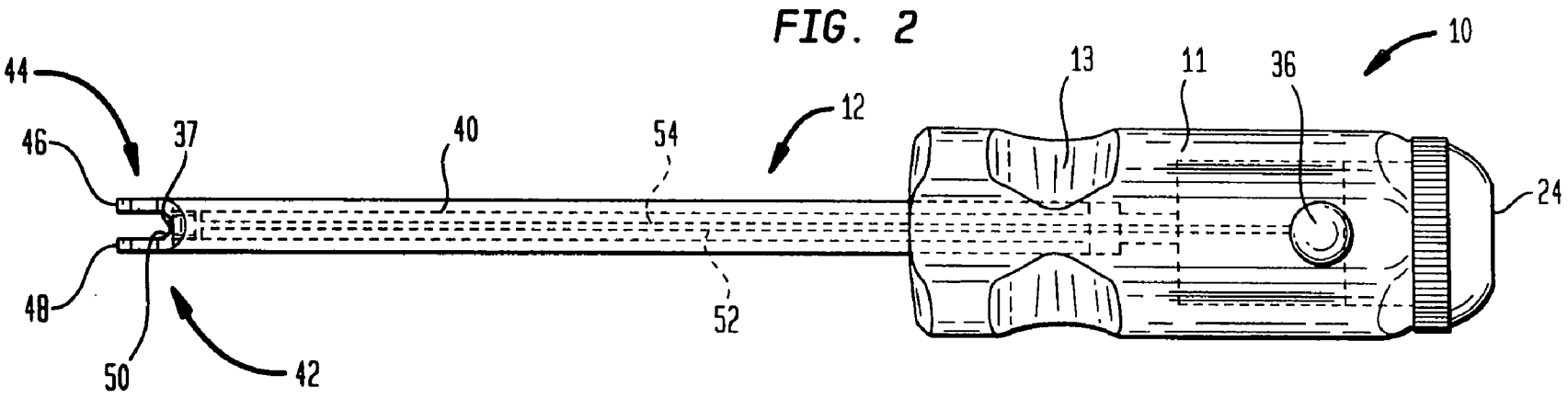
FIG. 2 is a top plan view of the screwdriver of FIG. 1.
Figure 3:
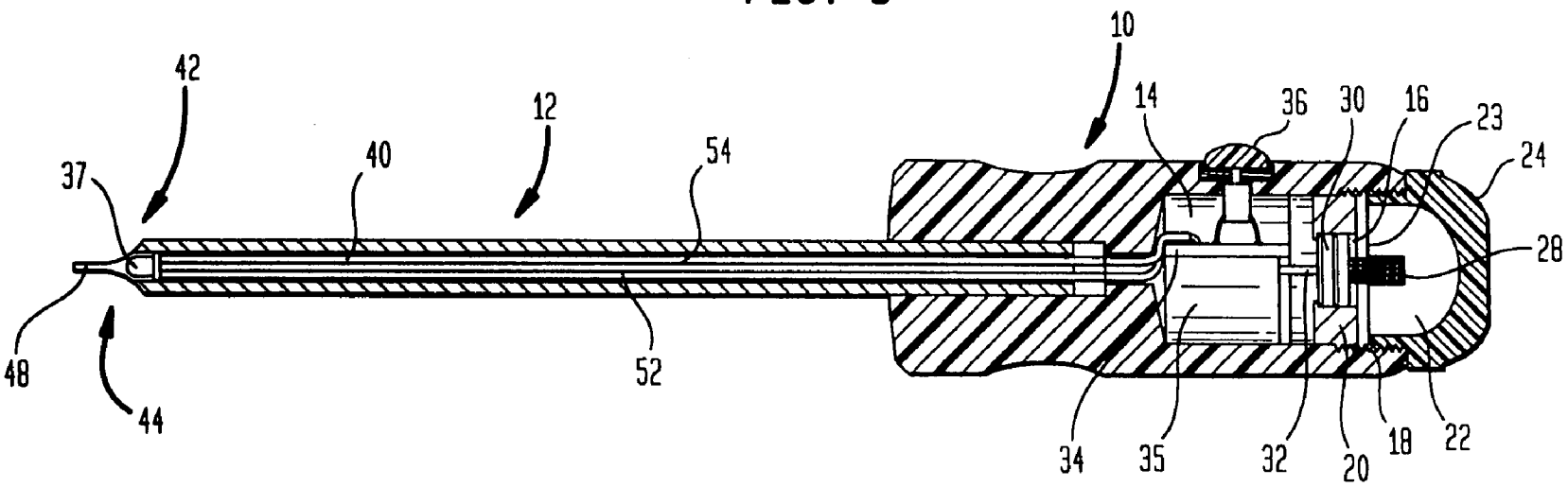
FIG. 3 is a side cross-sectional view of the screwdriver of FIG. 1.

As seen in FIGS. 1-3, the first preferred embodiment of the screwdriver of the present invention includes a handle, generally designated 10, from one end of which a shaft, generally designated 12, extends. Handle 10 is preferably provided with circumferentially spaced outwardly protruding grip members 11 with recesses 13 to accommodate the fingers of the user. Shaft 12 is preferably made of hardened steel and preferably has a diameter of approximately one quarter of an inch.

Handle 10 may be made of any conventional material, such as plastic, rubber or wood. Handle 10 has a hollow cavity 14. Within cavity 14 is situated an open ended battery receiving chamber 16. Chamber 16 is defined by a substantially cylindrical wall formed of an electrically conductive outer wall layer 18 and an electrically non-conductive inner wall layer 20.

The rear end of cavity 14 defines an internally threaded battery receiving opening 22. Opening 22 is adapted to receive the body 23 of an externally threaded cover member 24. Member 24 is removable from the handle by rotation to provide access to chamber 16 for insertion and replacement of batteries.

Body 23 of cover member 24 has an electrically conductive inner bottom surface 26. An electrically conductive spring 28 extends inwardly from the center of surface 26 towards the interior of chamber 16. Spring 28 has the double function of maintaining the batteries within chamber 16 in the proper position and providing a secure electrical connection between one pole of the batteries and conductive surface 26 of the cover member. When cover member 24 is in place within opening 22, the electrically conductive inner surface 26 of cover 24 abuts and is in electrical connection with conductive wall layer 18.

One or more flat batteries 30 are situated, front to back, within chamber 16, in series electrical contact with each other, between spring 28 and a stationary contact pin 32. Pin 32 is electrically connected to one input of a circuit board 34 situated adjacent to chamber 16. The other input of circuit board 34 is connected to the other pole of batteries 30 via spring 28, the electrically conductive inner surface 26 of cover 24 and electrically conductive outer wall layer 18.

Circuit board 34 forms the base of a spring-loaded push-button 36 which extends through an opening in the handle wall and is externally accessible. Circuit board 34 is mounted on a "U" shaped support 35 and is connected to a LED 37 situated within the screw-engaging end of a bore 40 which extends the entire length of shaft 12. Pin 32 is fixed within support 35, in alignment with batteries 30.

In this preferred embodiment, the screw-engaging end 42 of shaft 12 takes the form of a bifurcated blade 44. Blade 44 is composed of spaced blade sections 46, 48. Between blade sections 46, 48 is situated an opening 50, which is the open end of bore 40. LED 37 is lodged in the very end of bore 40, proximate opening 50. Wires 52 and 54, which extend the entire length of bore 40, connect LED 37 with the outputs of circuit board 34.

In use, the application of inwardly directed force on pushbutton 36 causes circuit board 34 to complete the electrical circuit between batteries 30 and LED 37. That causes the LED to be energized and to project light out opening 50 at the end of bore 40, between blade sections 46, 48, to illuminate the area proximate the screw-engaging end 42 of shaft 12.

Figure 4:
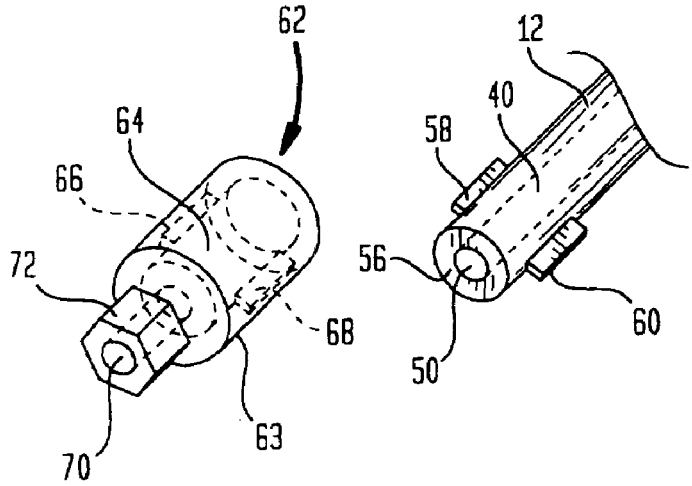
FIG. 4 is a perspective, exploded view of the screw-engaging end of the shaft of a second preferred embodiment of the present invention along with a typical head.

FIGS. 4 through 7 illustrate a second preferred embodiment of the present invention. As illustrated in FIG. 4, the second preferred embodiment of the present invention is the same as the first preferred embodiment except that the screw-engaging end of shaft 12 is designed to accept a removable head, more particularly, one of a plurality of interchangeable heads, generally designated 62. In this embodiment, blade sections 46, 48 are eliminated, leaving a flat shaft end 56 surrounding opening 50 of bore 40. Further, axially elongated protrusions 58, 60, extending outwardly from the wall of shaft 12 in opposite directions, are provided.

Figure 5:
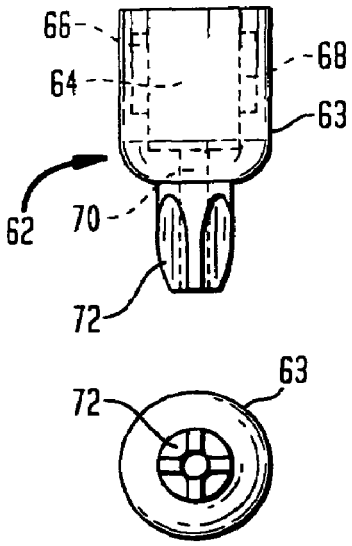
FIG. 5 shows a side plan view and a front plan view of an interchangeable head for a Philips head screw.
Figure 6:
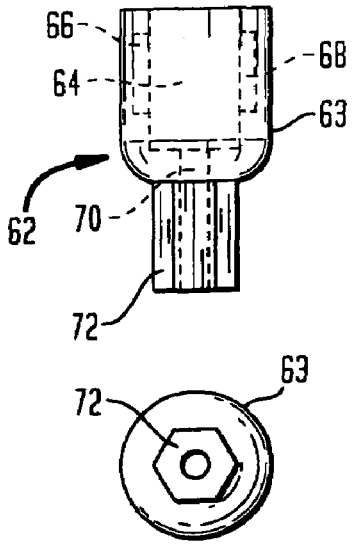
FIG. 6 shows a side plan view and a front plan view of an interchangeable head for a hexagonal head screw.
Figure 7:
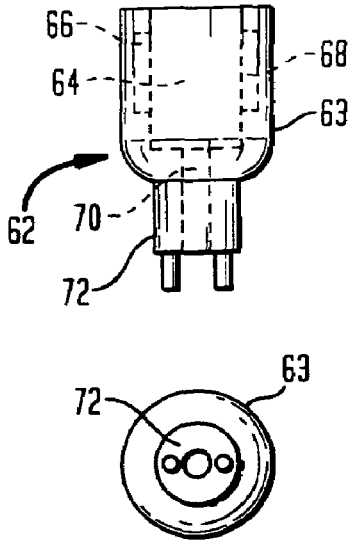
FIG. 7 shows a side plan view and a front plan view of an interchangeable head for a Spanner head screw.

FIGS. 5, 6 and 7 illustrate three possible interchangeable heads 62 that could be mounted on the screw-engaging end 56 of the shaft of the second preferred embodiment of the invention. In each case, the head 62 has a mounting section 63 with an internal axial bore 64 with an internal diameter slightly larger than the external diameter of the shaft end 56 such that the head can be mounted snuggly on the shaft end.

The bore 64 of each head 62 has oppositely oriented, axially extending slots 66, 68. Slots 66, 68 are shaped and positioned to receive protrusions 58, 60, respectively, when the head is mounted on the end of the shaft. Slots 66, 68 cooperate with protrusions 58, 60 to prevent relative rotation between the shaft and the head, permitting the transfer of torque from the screwdriver shaft to the head.

Each head 62 also has a screw-engaging portion 72 with an internal axial bore 70 adapted to align with opening 50 in bore 40 when the head is mounted on the shaft end. When the head is mounted, and the pushbutton is depressed, light from LED 37 travels from opening 50 through bore 70 to illuminate the area in front of the head.

FIG. 5 shows the side and front of a head designed for use with a Philips head screw. The screw-engaging portion 72 of the head illustrated therein has the configuration of a standard Philips head screwdriver, except for bore 70.

FIG. 6 shows the side and front of a head designed for use with a hexagonal head screw. The screw-engaging portion 72 of the head illustrated therein has the configuration of a standard hexagonal head tool, except for bore 70.

FIG. 7 shows the side and front of a head designed for use with a Spanner head screw. The screw-engaging portion 72 of the head illustrated therein has the configuration of a standard Spanner head screwdriver, except for bore 70.

Interchangeable heads designed to drive screws with other configurations are possible, as well.

It will now be appreciated that the present invention relates to a screwdriver with a handle and a rigid shaft that extends from the handle. The shaft has an end formed to engage a screw. It also has a bore that extends through the shaft from the handle to the screw-engaging end of the shaft. An LED is situated in the bore, proximate the screw-engaging end of the shaft. The handle has a recess. A battery is situated within the recess. Means are provided for electrically connecting the LED and the battery.

The connecting means include a switch and wire means extending through the bore, between the LED and the battery in the handle.

In the first preferred embodiment, the screw-engaging end of the shaft takes the form of a bifurcated blade. In the second preferred embodiment, interchangeable heads designed for use with different types of screws are provided for mounting on the shaft.

While only a limited number of preferred embodiments of the present invention have been disclosed for purposes of illustration, it is obvious that many modifications and variations could be made thereto. It is intended to cover all of those modifications and variations which fall within the scope of the present invention, as defined by the following claims.

I claim:

1. A screwdriver with a handle and a rigid shaft with a screw-engaging end, said shaft extending from said handle and having a bore, said bore having a substantially uniform diameter and extending through said shaft from said handle to said screw-engaging end, a LED situated in said bore, proximate said screw-engaging end of said shaft, said handle having a recess, a battery having first and second opposite poles situated within said recess, and switch means, actuatable in response to the depression of a pushbutton accessible from the exterior of the said handle, for electrically connecting said LED and said battery to energize said LED to illuminate the area proximate said screw-engaging end of said shaft, said switch means comprising a circuit board mounted in said handle recess by a "U" shaped support and having first and second inputs connected to said opposite poles of said battery, respectively, and first and second outputs connected to said LED, at least one of said outlets being connected to said LED by a wire extending within said bore.

2. The screwdriver of claim 1 wherein said shaft has an outer diameter of approximately one quarter inch and said bore has an inner diameter of approximately one eight inch.

3. The screwdriver of claim 1 wherein said screw-engaging end of said shaft comprises a bifurcated blade.

4. The screwdriver of claim 3 wherein said blade comprises spaced blade sections.

5. The screwdriver of claim 4 wherein said spaced blade sections are situated on either side of said LED.

6. The screwdriver of claim 1 wherein said handle has an end with a removable cover member.

7. The screwdriver of claim 1 further comprising at least one removable head.

8. The screwdriver of claim 1 further comprising a plurality of interchangeable heads adapted to be mounted on said screw-engaging end of said shaft for use with screws of different configurations, each of said heads comprising a bore aligned with said shaft bore.

9. The screwdriver of claim 1 wherein said bore has an axis and said circuit board is mounted within said handle recess in a plane substantially parallel to said axis of said bore.

10. The screwdriver of claim 9 wherein said plane is offset from said axis of said bore.

11. The screwdriver of claim 9 wherein said pushbutton extends in a direction substantially perpendicular to said plane.

12. The screwdriver of claim 1 further comprising a pin fixed within said support and aligned with one of said poles of said battery.

* * * * *